US007992714B1

(12) United States Patent
Devault et al.

(10) Patent No.: US 7,992,714 B1
(45) Date of Patent: Aug. 9, 2011

(54) TODDLER FOOD TRAY ASSEMBLY

(76) Inventors: Diane M. Devault, Riverside, CA (US); Steven E. Wagner, Riverside, CA (US)

( * ) Notice: Subject to any disclaimer, the term of this patent is extended or adjusted under 35 U.S.C. 154(b) by 0 days.

(21) Appl. No.: 12/713,255

(22) Filed: Feb. 26, 2010

(51) Int. Cl.
*B65D 1/36* (2006.01)

(52) U.S. Cl. ..... 206/564; 206/562; 206/565; 220/556; 220/575; 108/26

(58) Field of Classification Search ..... 206/217, 206/562, 563, 564, 565; 220/574, 575, 556, 220/23.86; 108/26; 297/188.01
See application file for complete search history.

(56) References Cited

U.S. PATENT DOCUMENTS

| | | | | |
|---|---|---|---|---|
| 1,377,588 | A * | 5/1921 | Kayser | 108/26.2 |
| 2,640,595 | A * | 6/1953 | Byford | 211/74 |
| 2,652,702 | A | 9/1953 | Hintze | |
| 2,850,079 | A * | 9/1958 | Prushnok et al. | 248/506 |
| 3,233,804 | A | 2/1966 | Dahm | |
| 3,475,052 | A * | 10/1969 | Kaposi | 297/153 |
| 4,908,066 | A * | 3/1990 | Taylor et al. | 108/26 |
| 4,927,024 | A * | 5/1990 | Lloyd | 206/562 |
| 5,586,800 | A * | 12/1996 | Triplett | 297/148 |
| 5,720,226 | A * | 2/1998 | Padovano | 108/25 |
| D418,024 | S | 12/1999 | Howell et al. | |
| 6,484,989 | B1 | 11/2002 | Connery | |
| 7,201,440 | B2 * | 4/2007 | Heck et al. | 297/148 |
| 7,475,937 | B2 * | 1/2009 | McGrew et al. | 297/148 |
| 2004/0178253 | A1 | 9/2004 | Stier | |
| 2008/0149580 | A1 | 6/2008 | Hill | |

* cited by examiner

*Primary Examiner* — David T Fidei

(57) ABSTRACT

A toddler food tray assembly includes a panel that has a top side, a bottom side and a perimeter edge. The panel has a plurality of apertures therein extending through the top and bottom sides. The perimeter edge has a front edge. A plurality of sleeves is provided. Each of the sleeves has a closed lower end and an upper edge defining an access opening. Each of the apertures has a peripheral edge that is attached to and coextensive with one of the upper edges of the sleeves. The sleeves each extend downwardly from the panel. A plurality of food supporting members is provided. Each of the food holding supporting members has a bottom wall and a peripheral wall that is attached to and extends upwardly from the bottom wall. Each of the bottom walls includes a mount that is extendable into one of the sleeves.

15 Claims, 7 Drawing Sheets

TODDLER FOOD TRAY ASSEMBLY

BACKGROUND OF THE DISCLOSURE

Field of the Disclosure

The disclosure relates to toddler food tray devices and more particularly pertains to a new toddler food tray device for retaining food dishes on a tray to prevent their spillage.

SUMMARY OF THE DISCLOSURE

An embodiment of the disclosure meets the needs presented above by generally comprising a panel that has a top side, a bottom side and a perimeter edge. A perimeter flange is attached to and extends downwardly from the panel. The panel has a plurality of apertures therein extending through the top and bottom sides. The perimeter edge has a front edge. A plurality of sleeves is provided. Each of the sleeves has a closed lower end and an upper edge defining an access opening. Each of the apertures has a peripheral edge that is attached to and coextensive with one of the upper edges of the sleeves. The sleeves each extend downwardly from the panel. A plurality of food supporting members is provided. Each of the food holding supporting members has a bottom wall and a peripheral wall that is attached to and extends upwardly from the bottom wall. Each of the bottom walls includes a mount that is extendable into one of the sleeves.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
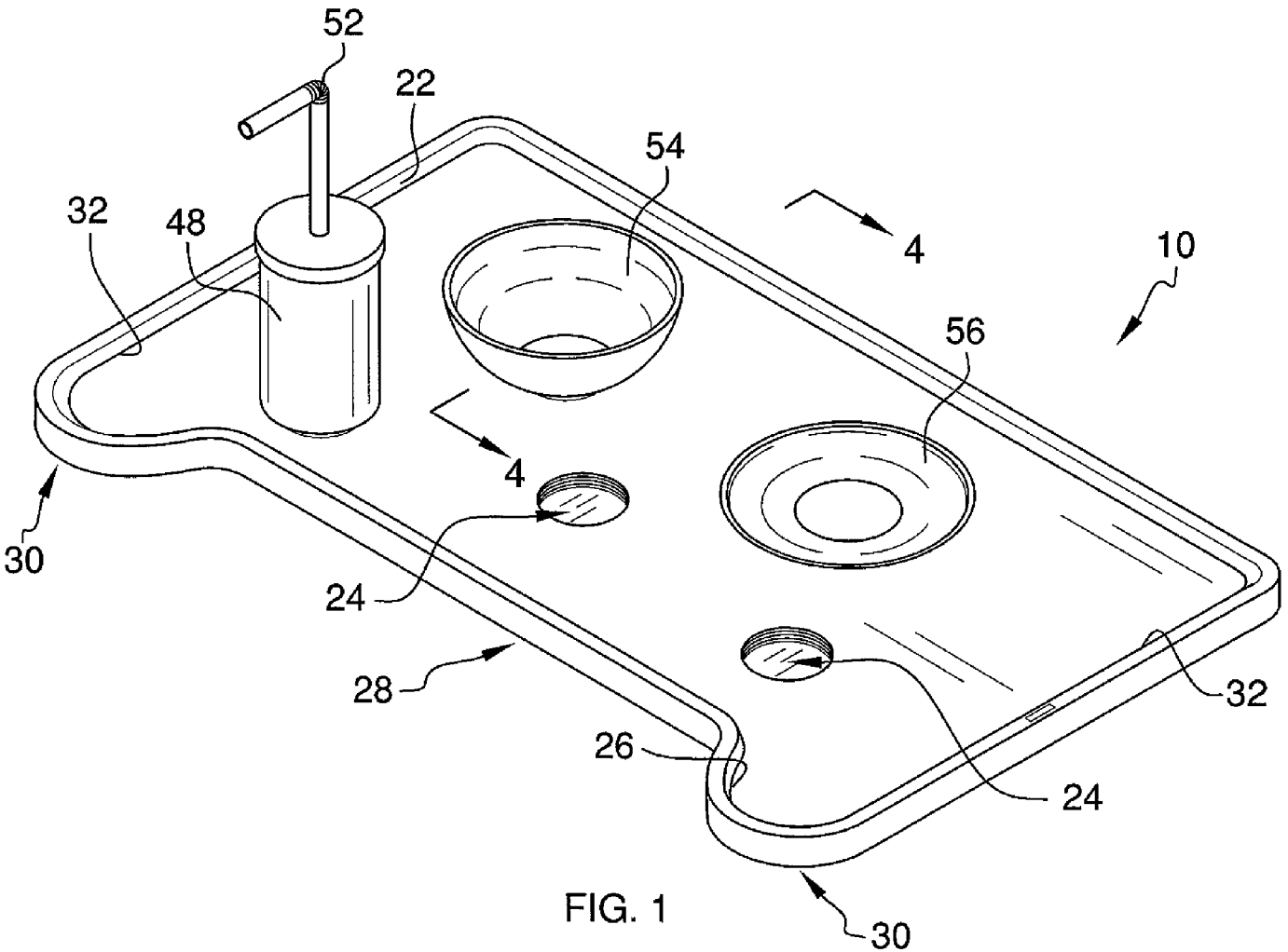
FIG. 1 is a top perspective view of a toddler food tray assembly according to an embodiment of the disclosure.
Figure 2:
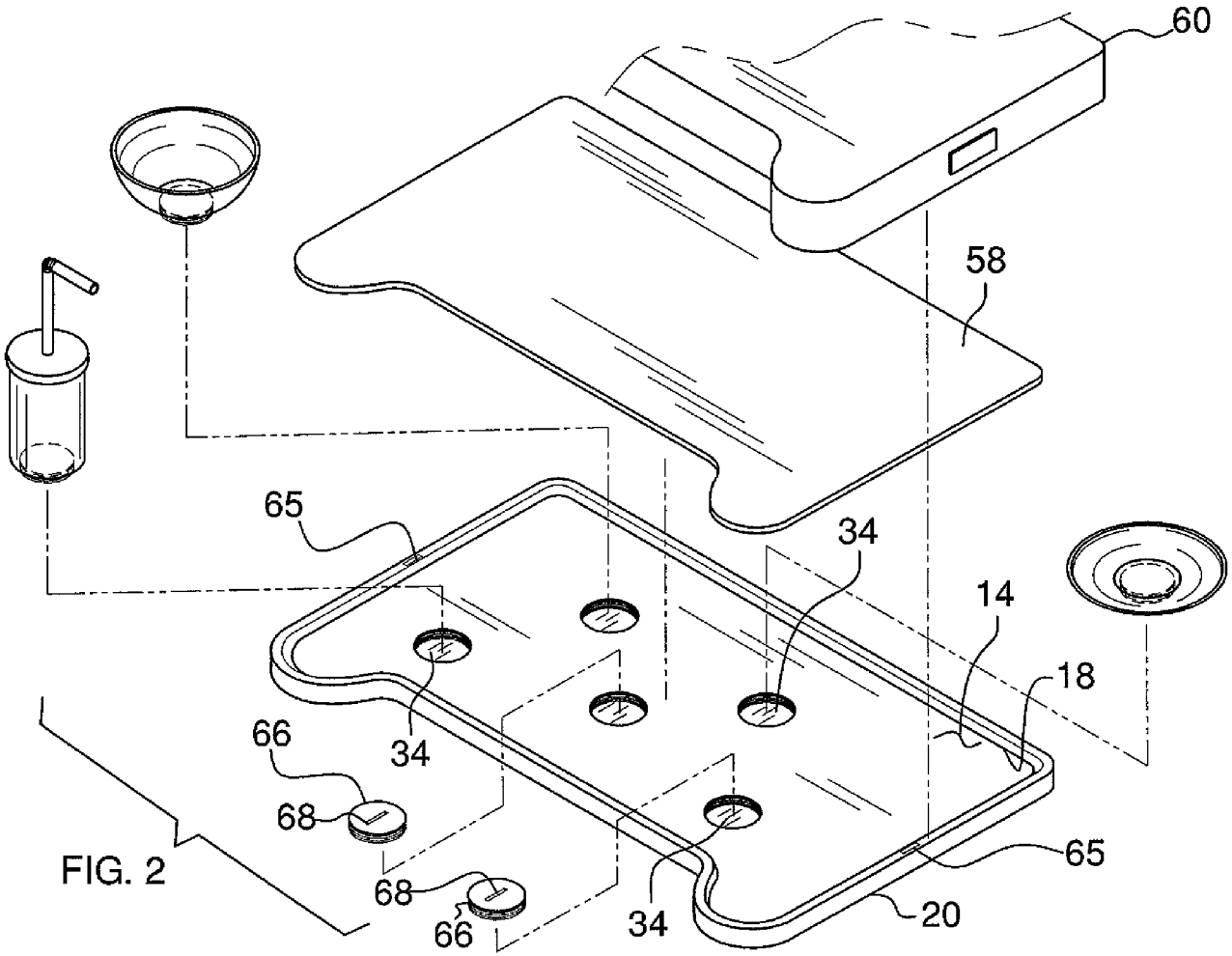
FIG. 2 is a top perspective exploded view of an embodiment of the disclosure.
Figure 3:
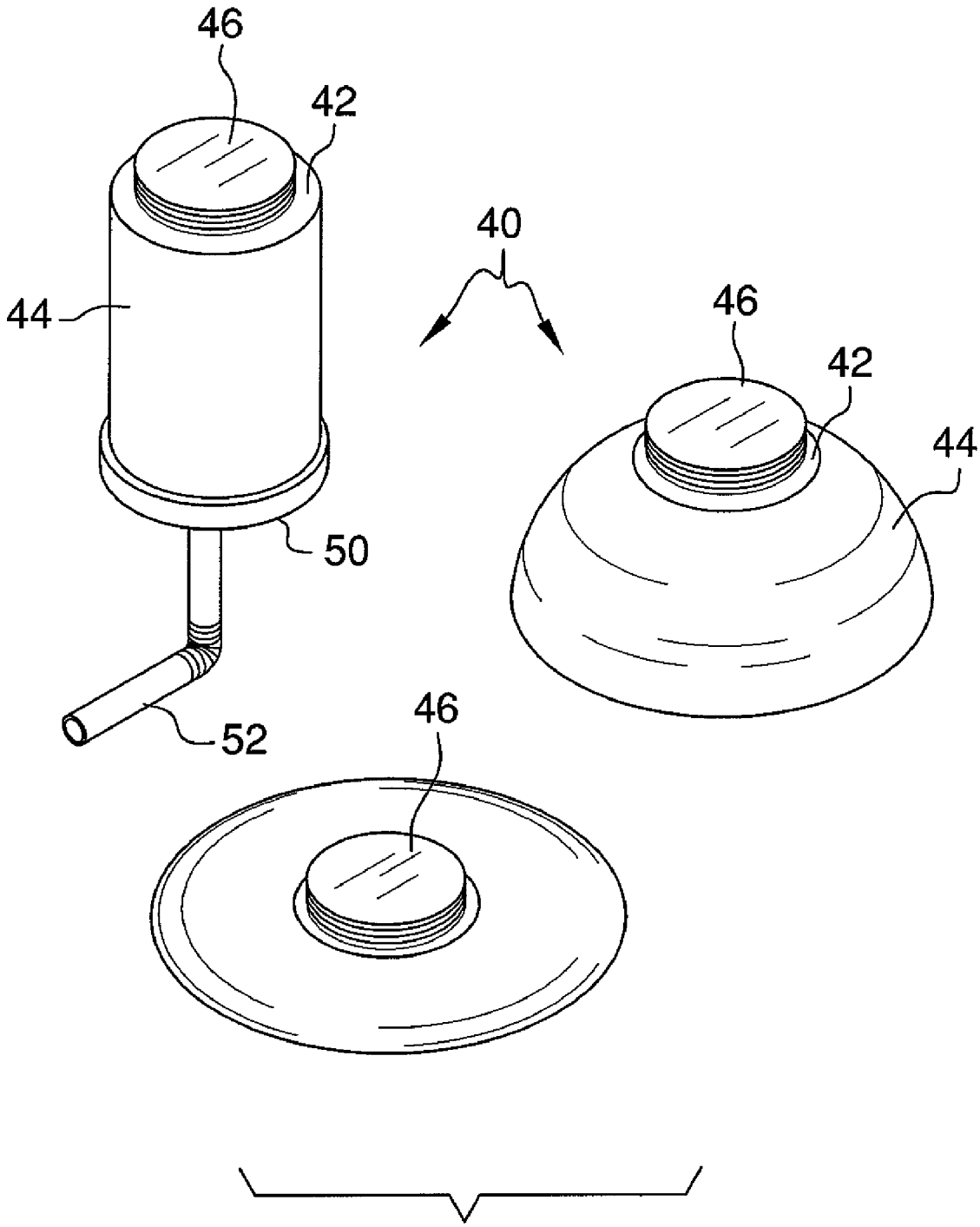
FIG. 3 is a bottom perspective view of food supporting members of an embodiment of the disclosure.
Figure 4:
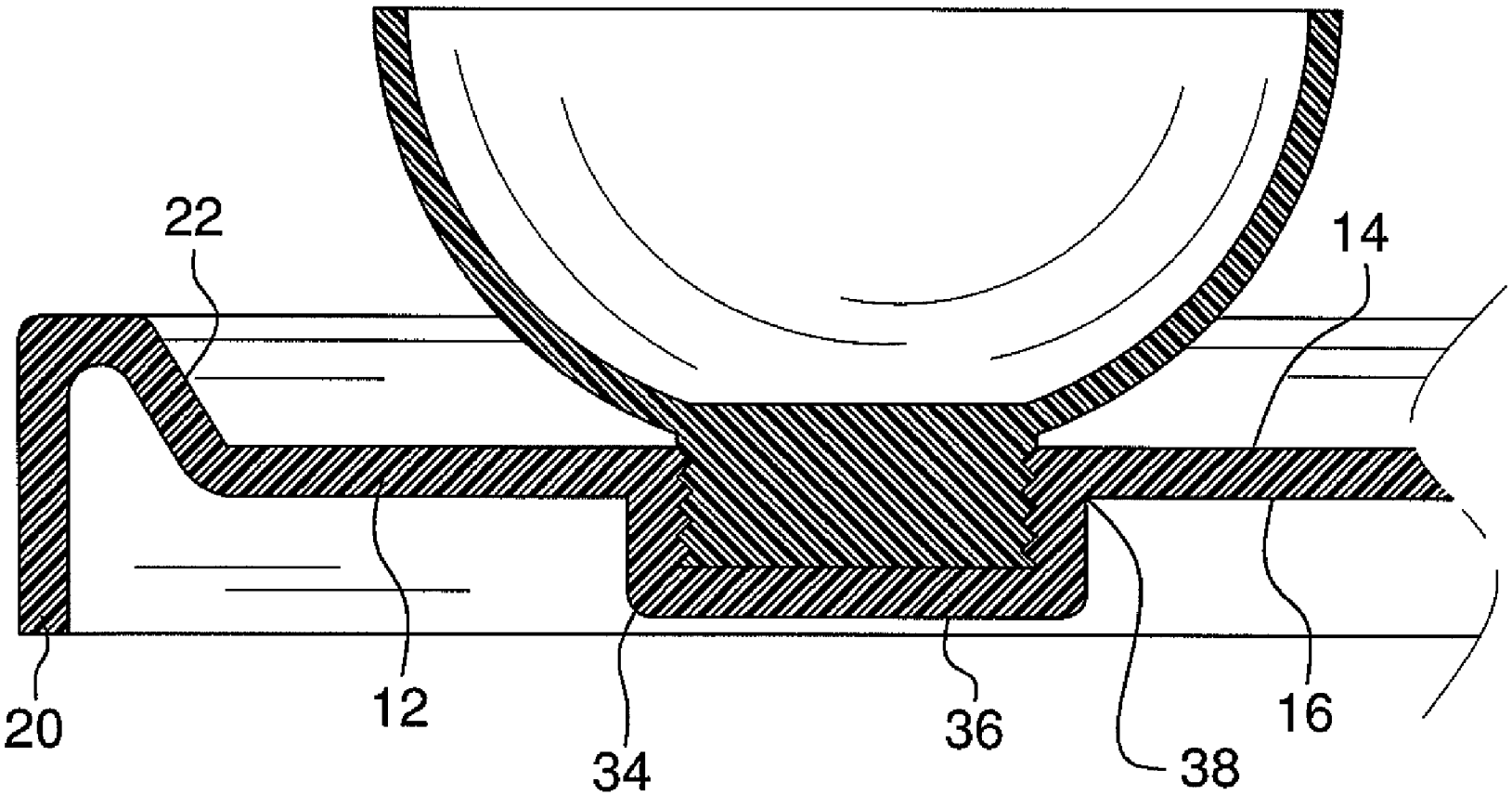
FIG. 4 is a cross-sectional view taken along line 4-4 of FIG. 1 of an embodiment of the disclosure.

With reference now to the drawings, and in particular to FIGS. 1 through 7 thereof, a new toddler food tray device embodying the principles and concepts of an embodiment of the disclosure and generally designated by the reference numeral 10 will be described.

Figure 5:
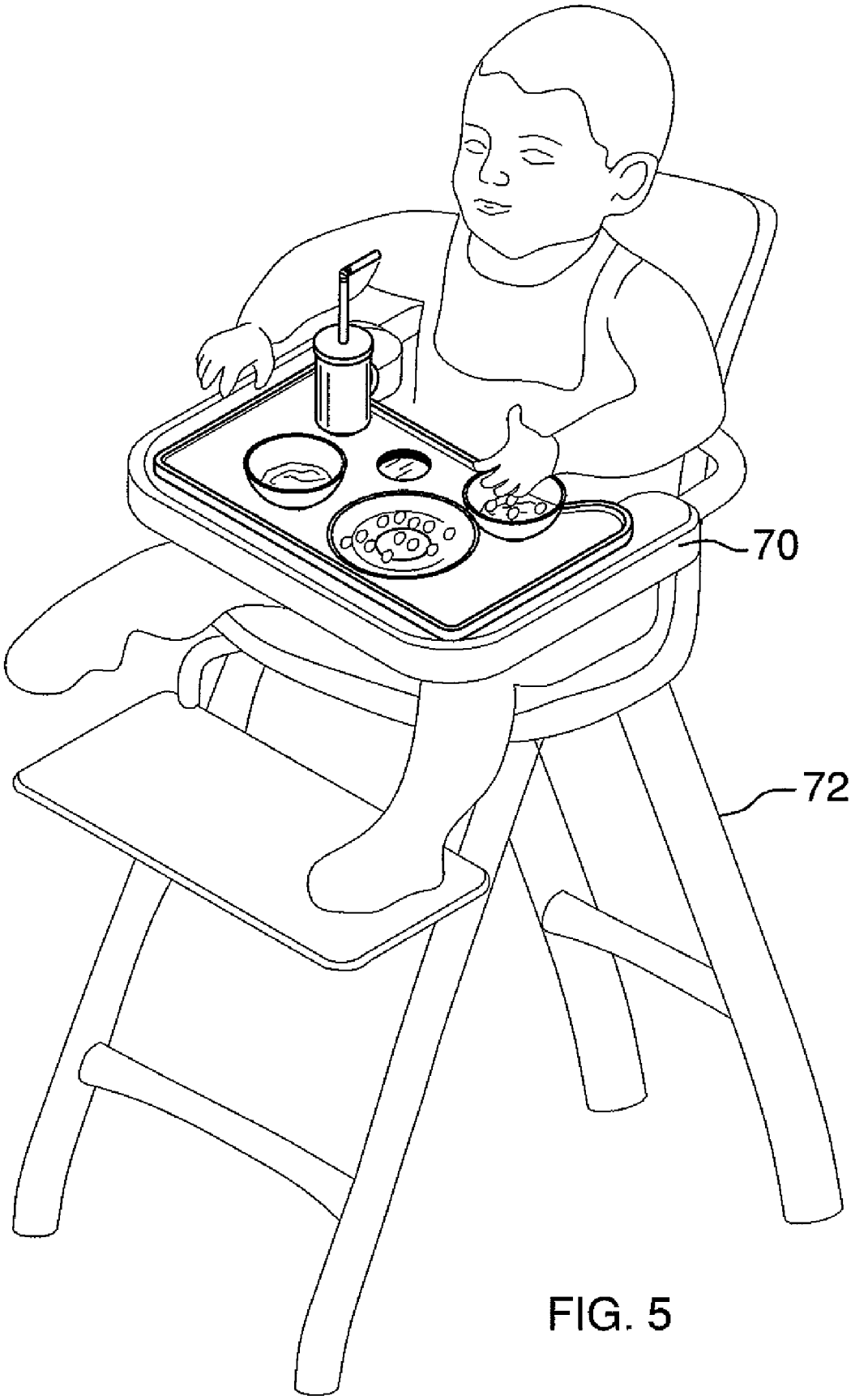
FIG. 5 is a perspective in-use view of an embodiment of the disclosure.
Figure 6:
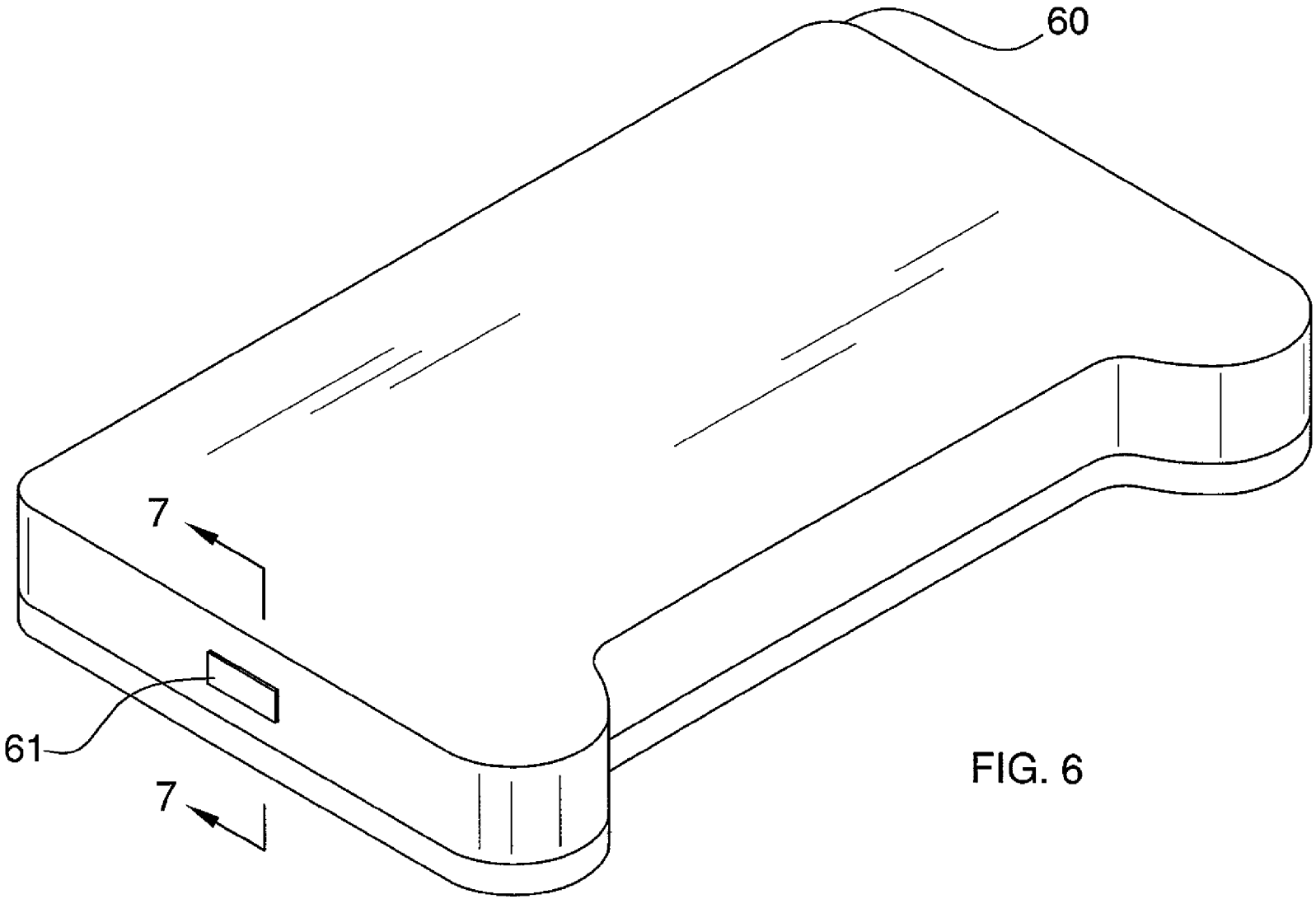
FIG. 6 is a top view taken of an embodiment of the disclosure.

As best illustrated in FIGS. 1 through 7, the toddler food tray assembly 10 generally comprises a panel 12 that has a top side 14, a bottom side 16 and a perimeter edge 18. A perimeter flange 20 is attached to and extends downwardly from the panel 12. The flange 20 elevates the bottom side 16 off of a support surface. The flange 20 may be attached to a perimeter ridge 22 of the panel 12 which extends upwardly from the top side 14. The panel 12 has a plurality of apertures 24 therein extending through the top 14 and bottom 16 sides. The perimeter edge 18 has a front edge 26. The front edge 26 includes an elongated indented central area 28 to define wings 30 positioned between the central area 28 and lateral edges 32 of the panel 12. The wings 30 are extendable around a toddler as shown in FIG. 5. The panel 12 preferable has a size to fit within the confines of chair tray 70 attached to a highchair 72 or booster chair.

A plurality of sleeves 34 is provided. Each of the sleeves 34 has a closed lower end 36 and an upper edge 38 defining an access opening. Each of the apertures 24 has a peripheral edge that is attached to and coextensive with one of the upper edges 38 of the sleeves 34. The sleeves 34 each extends downwardly from the panel 12.

A plurality of food supporting members 40 is provided. Each of the food holding supporting members 40 has a bottom wall 42 and a peripheral wall 44 that is attached to and extends upwardly from the bottom wall 42. Each of the bottom walls 42 includes a mount 46 that is extendable into one of the sleeves 34. The mounts 46 are each threaded and are threadably couplable to an associated one of the sleeves 34 to releasably secure the supporting members 40 to the sleeves 34. This prevents a child from picking up and throwing or tipping the food supporting members 40. At least one of the supporting members 40 comprises a drinking cup 48 that has a cover 50 removable mounted thereon. A straw 52 extends through the cover 50 to allow the toddler to drink from the drinking cup 48 without having to pick up the drinking cup 48. At least one of the supporting members 40 comprises a bowl 54 and at least one of the supporting members 40 comprises a plate 56.

A liner 58 is removably positionable on the top side 14 of the panel 12 to cover the apertures 24 when the food supporting members 40 are removed from the sleeves 34 to form a planar upper surface. This will allow the top side 14 of the panel 12 to be used without the food containers 40 while ensuring that the sleeves 34 are not filled with food and for providing easy cleanup by simply removing and cleaning the liner 58. The liner may be comprised of a plastic material that is either rigid or resiliently bendable.

Figure 7:
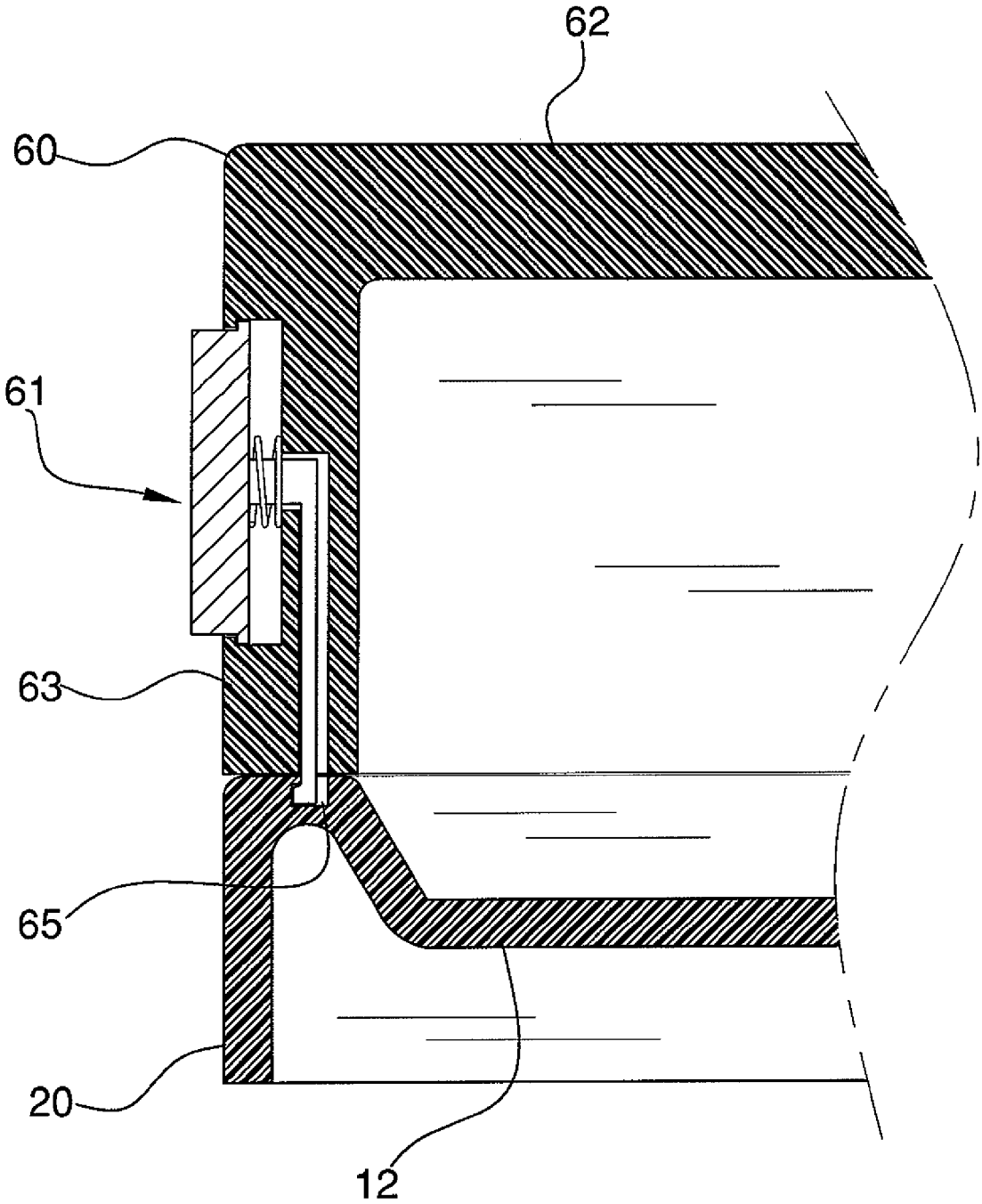
FIG. 7 is a cross-sectional view of an embodiment of the disclosure taken along line 7-7 of FIG. 6.

Additionally, the assembly 10 may include a housing 60 removably positionable on and engageable with the perimeter flange 20 to completely seal and cover the panel 12 and cover 50. As can be seen in FIG. 7, the housing 60 may include a lock 61 extendable into and removably engaged with a notch 65 in the perimeter flange 20 to releasably lock the housing 20 to the perimeter flange 20. The housing 60 includes a top wall 62 and a circumferential wall 63 being attached to and extending downwardly from the top wall 62. The top wall 62 has a shape and size corresponding to the shape and size of the panel 12 so that the circumferential wall 63 aligns with the perimeter flange 20.

Plugs 66, which are threaded, may be insertable into the apertures 24 and engageable with the sleeves 34 to fill in the sleeves 34 when such are not being used. The plugs 66 may include an upper surface with a slot 68 therein to assist a person in rotating the plug 66 as it is threadably engaged or disengaged from the sleeve 34.

In use, the panel is placed in the chair tray 72 and each of the sleeves 24 is engaged with one of the mounts 46. The food supporting members 40 hold food to be eaten while the mounts 46 prevent the child from throwing or tipping the food supporting members 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A toddler eating tray assembly comprising:

a panel having a top side, a bottom side and a perimeter edge, a perimeter flange being attached to and extending downwardly from said panel, said panel having a plurality of apertures therein extending through said top and bottom sides, said perimeter edge having a front edge;

a plurality of sleeves, each of said sleeves having a closed lower end and an upper edge defining an access opening, each of said apertures having a peripheral edge being attached to and coextensive with one of said upper edges of said sleeves, said sleeves each extending downwardly from said panel; and a plurality of food supporting members, each of said food holding supporting members having a bottom wall and a peripheral wall being attached to and extending upwardly from said bottom wall, each of said bottom walls including a mount being extendable into one of said sleeves; and a plurality of plugs, said plugs being configured to be insertable into said apertures to fill said sleeves when said sleeves are not occupied by one of said mounts.

2. The assembly according to claim 1, wherein said perimeter edge has a front edge, said front edge including an elongated indented central area to define wings positioned between said central area and lateral edges of said panel.

3. The assembly according to claim 1, wherein each of said mounts is threaded and being threadably couplable to an associated one of said sleeves to releasably secure said supporting members to said sleeves.

4. The assembly according to claim 1 wherein at least one of said supporting members comprises a drinking cup that has a cover removable mounted thereon, a straw extending through said cover.

5. The assembly according to claim 4, wherein at least one of said supporting members comprises a bowl and at least one of said supporting members comprises a plate.

6. The assembly according to claim 1, further including a liner being removably positionable on said top side of said panel to cover said apertures when said food supporting members are removed from said sleeves to form a planar upper surface.

7. A toddler eating tray assembly comprising:

a panel having a top side, a bottom side and a perimeter edge, a perimeter flange being attached to and extending downwardly from said panel, said panel having a plurality of apertures therein extending through said top and bottom sides, said perimeter edge having a front edge, said front edge including an elongated indented central area to define wings positioned between said central area and lateral edges of said panel;

a plurality of sleeves, each of said sleeves having a closed lower end and an upper edge defining an access opening, each of said apertures having a peripheral edge being attached to and coextensive with one of said upper edges of said sleeves, said sleeves each extending downwardly from said panel;

a plurality of food supporting members, each of said food holding supporting members having a bottom wall and a peripheral wall being attached to and extending upwardly from said bottom wall, each of said bottom walls including a mount being extendable into one of said sleeves, each of said mounts being threaded and being threadably couplable to an associated one of said sleeves to releasably secure said supporting members to said sleeves, at least one of said supporting members comprising a drinking cup having a cover removable mounted thereon, a straw extending through said cover, at least one of said supporting members comprising a bowl, at least one of said supporting members comprising a plate; and a liner being removably positionable on said top side of said panel to cover said apertures when said food supporting members are removed from said sleeves to form a planar upper surface; and a plurality of plugs, said plugs being configured to be insertable into said apertures to fill said sleeves when said sleeves are not occupied by one of said mounts.

8. The assembly according to claim 1, wherein each of said plugs is threaded and is threadably couplable to an associated one of said sleeves.

9. The assembly according to claim 8, wherein each of said plugs has an upper surface having a slot therein to facilitate the rotation of said plugs.

10. The assembly according to claim 7, wherein each of said plugs is threaded and is threadably couplable to an associated one of said sleeves.

11. The assembly according to claim 10, wherein each of said plugs has an upper surface having a slot therein to facilitate the rotation of said plugs.

12. The assembly according to claim 4, further including a housing being removably positionable on and engageable with said perimeter flange to completely seal and cover said panel and cover.

13. The assembly according to claim 12, wherein said housing includes a lock being extendable into and removably engageable with a notch in said perimeter flange to releasably lock said housing to said perimeter flange, said housing including a top wall and a circumferential wall attached to and extending downwardly from said top wall, said top having a shape and size corresponding to a shape and size of said panel such that said circumferential wall aligns with said perimeter flange.

14. The assembly according to claim 7, further including a housing being removably positionable on and engageable with said perimeter flange to completely seal and cover said panel and cover.

15. The assembly according to claim 14, wherein said housing includes a lock being extendable into and removably engageable with a notch in said perimeter flange to releasably lock said housing to said perimeter flange, said housing including a top wall and a circumferential wall attached to and extending downwardly from said top wall, said top having a shape and size corresponding to a shape and size of said panel such that said circumferential wall aligns with said perimeter flange.

* * * * *